US005806357A

United States Patent [19]

Bouchillon et al.

[11] Patent Number: 5,806,357

[45] Date of Patent: Sep. 15, 1998

[54] SYSTEM AND METHOD FOR ROLLING TAPERED SLABS

[75] Inventors: Milton Scott Bouchillon, Alpharetta, Ga.; Dietrich Wohld, Buchenweg 4 b, Germany

[73] Assignee: Siemens Aktiengesellschaft, Munich, Germany

[21] Appl. No.: 735,301

[22] Filed: Oct. 22, 1996

Related U.S. Application Data

[60] Provisional application No. 60/010,441 Jan. 23, 1996.

[51] Int. Cl.[6] ..... B21B 37/12

[52] U.S. Cl. ..... 72/10.2; 72/10.3; 72/29.1

[58] Field of Search ..... 72/10.2, 10.3, 72/29.1, 205, 234

[56] References Cited

U.S. PATENT DOCUMENTS

| | | | |
|---|---|---|---|
| 3,200,624 | 8/1965 | Tix . | |
| 3,550,414 | 12/1970 | List | 72/205 |
| 4,408,470 | 10/1983 | Fromont et al. | 72/10.2 |
| 5,113,678 | 5/1992 | Mannaka et al. | 72/205 |

FOREIGN PATENT DOCUMENTS

| | | | |
|---|---|---|---|
| 493 666 | 9/1976 | Australia . | |
| 0 369 555 | 5/1990 | European Pat. Off. . | |
| 1 602 203 | 4/1970 | Germany . | |
| 163514 | 9/1983 | Japan | 72/205 |

*Primary Examiner*—Lowell A. Larson
*Attorney, Agent, or Firm*—Kenyon & Kenyon

[57] ABSTRACT

A method and a device are provided for rolling a slab, in particular a slab whose thickness varies over its length, using at least two roll stands with a substantially constant and preferably low tension being maintained in the slab between the first and the second roll stand and with substantially constant exit thickness. Until the desired tension is reached in the slab, the rotational speed in the second roll stand is kept constant and the torque in the first roll stand is controlled so as to build up the desired tension in the slab between the first and the second roll stand. After the desired tension is reached, the rotational speed of the first roll stand and the torque of the second roll stand are kept constant.

10 Claims, 5 Drawing Sheets

SYSTEM AND METHOD FOR ROLLING TAPERED SLABS

RELATED APPLICATION

The instant application is based upon Provisional Application No. 60/010,441 filed Jan. 23, 1996 entitled IMPROVED LOOPERLESS TENSION CONTROL CONCEPT FOR A NON-REVERSING ROUGHING MILL WITH CHANGING ENTRY THICKNESS.

BACKGROUND OF THE INVENTION

In the casting of slabs, it is possible because of different requirements placed on the quality of the steel that the slabs vary in their thickness or width. This may occur, for example, between two sections of a slab having different thicknesses at a so-called tapered piece having either an increasing or decreasing thickness. Tapered pieces of this type are usually removed and melted again.

OBJECTS AND SUMMARY OF THE INVENTION

An object of the invention is to provide a system and a method that will enable slabs to be rolled without having to remove tapered pieces, in that the tapered pieces can be rolled at the same time while maintaining quality requirements.

The means for attaining this object is a method or a system for rolling slabs, in particular slabs, whose thickness varies over their length, using at least two roll stands. A substantially constant and preferably low tension is maintained in the slab between the first and the second roll stand. It has proven to be especially advantageous in this case to keep the tension in the slab constant by means of a control mechanism that keeps the rotational speed of the first roll stand and the torque of the second roll stand constant. However, until the desired nominal tension is built up in the slab between the first and the second roll stand, the speed of the second roll stand is advantageously held steady and the torque in the first roll stand is controlled so as to build up the desired nominal tension in the slab between the first and the second roll stand. After the desired nominal tension between the first and the second roll stand is attained, the control mechanism is switched over so as to hold steady the rotational speed in the first roll stand and the torque in the second roll stand.

It has proven to be especially advantageous not to control the tension directly, but rather by way of a corresponding reference torque. In so doing, it is not the tension in the slab, but rather the torque in the respective roll stand that is measured and is compared to a reference torque that corresponds to the nominal tension in the slab. Thus, the system deviation does not constitute the difference between the reference tension and the tension in the slab, but rather the difference between the reference torque and the torque in the respective roll stand.

The system according to the present invention includes an evaluation unit for evaluating the variable thickness of the slab. The evaluation unit is designed as a single-chip computer, in particular as a micro-controller, or as a multi-chip computer, in particular as a single-board or multi-board computer, or as a programmable controller. The evaluation unit may also be designed as one of a programmable controller, a SIMADYN-D system, a VME bus system and an industrial PC.

Other advantages and inventive details are revealed in the following detailed description of an exemplary embodiment with reference to the drawings.

DETAILED DESCRIPTION

Figure 1:
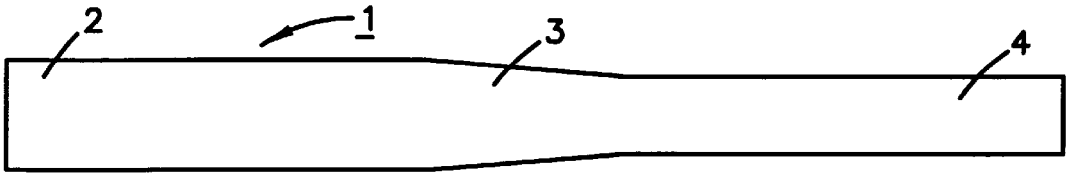
FIG. 1 is a side view of a slab with varying thickness.

FIG. 1 depicts a slab 1 with a varying thickness. The slab has a large size portion 2 and a small size portion 4, with the slab in the region of the large size portion 2 being thicker than in the region of the small size portion 4. Between the region of the large size portion 2 and the region of the small size portion 4 of the slab 1 is a region of varying thickness, i.e., a tapered piece 3, which makes up the thickness transition between the small size portion 4 and the large size portion 2. These tapered pieces are usually removed, and the large size portion 2 and the small size portion 4 are rolled separately. When working with the system according to the present invention, the slab 1 can be continually rolled while maintaining a high quality without having to sever the slab in the area of the tapered piece 3.

Figure 2:
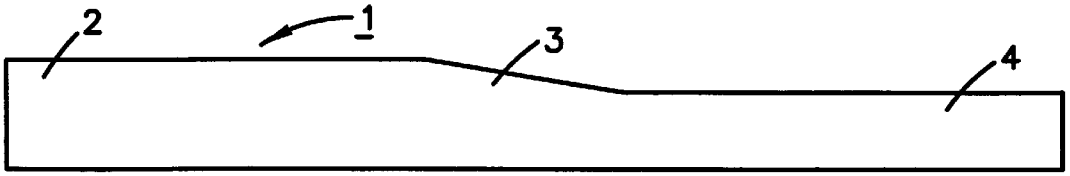
FIG. 2 is a side view of an alternative slab with varying thickness.

FIG. 2 shows a slab 1 having a varying thickness as an alternative to the slab of FIG. 1. It likewise has a large size portion 2 and a small size portion 4. Between the region of the large size portion 2 and the region of the small size portion 4 of the slab 1 is likewise a region of a varying thickness, the tapered piece 3.

Figure 3:
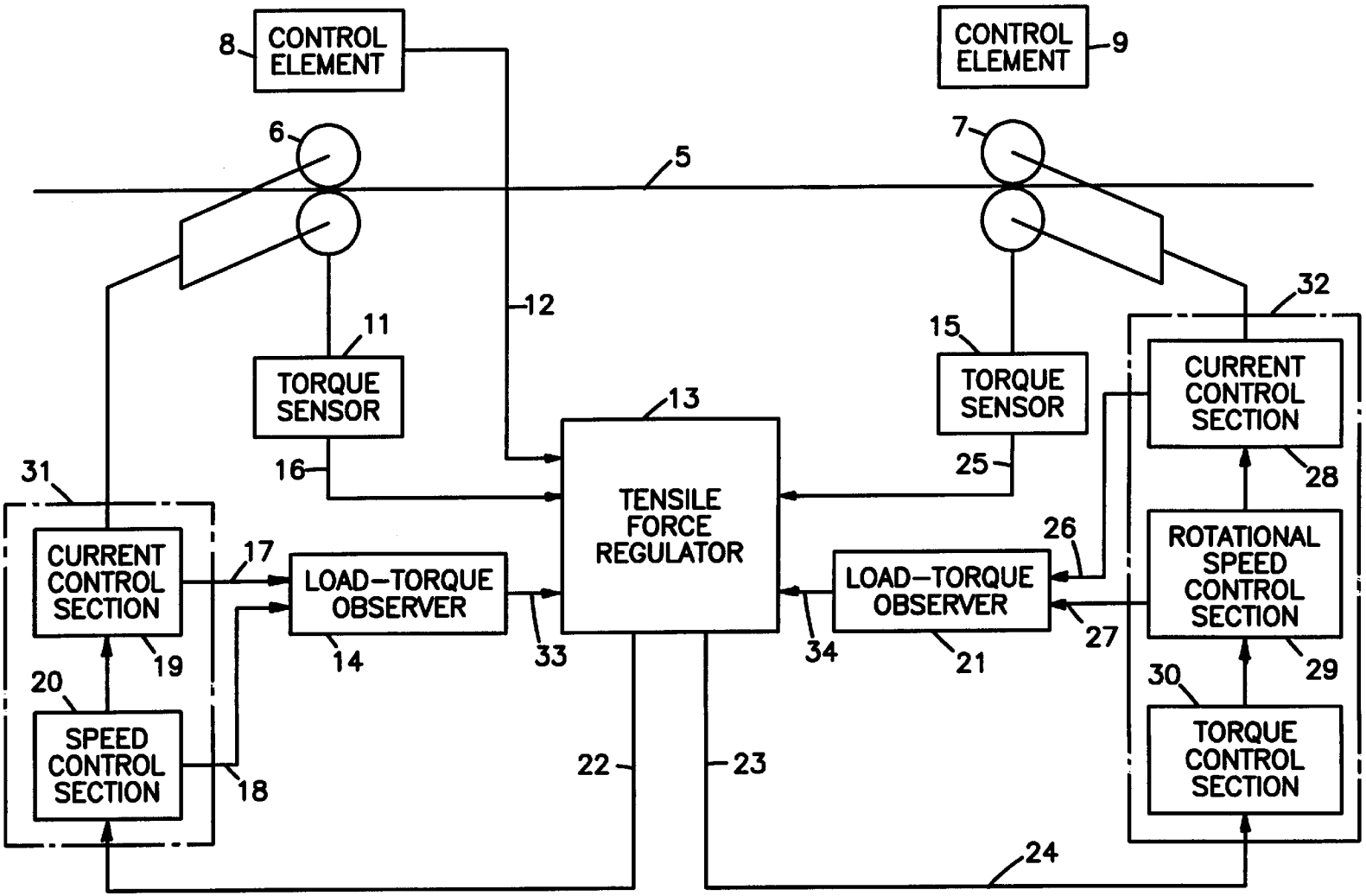
FIG. 3 is a block diagram illustrating a system in accordance with the invention for rolling slabs.

FIG. 3 shows a system according to the present invention for rolling slabs of different thickness while maintaining a high quality. The system has two roll stands: a first roll stand 6 and a second roll stand 7 for rolling the slab 5. The roll gap position of the roll stands 6 and 7 is adjusted by control elements 8 and 9. The roll gap of the roll stand 6 is controlled by the control element 8 so as to maintain a constant thickness of the material between roll stands 6 and 7. The control element 8 also supplies a value for the roll force 12. The rotational roll speed for the first roll stand 6 is regulated by a rotational speed regulator 31, and the roll torque of the second roll stand 7 by a torque regulator 32. The speed regulator 31 has a current control section 19 and a speed control section 20. The torque regulator 32 has a current control section 28, a rotational-speed control section 29, and a torque control section 30. In addition, the system has one torque sensor 11 and 15 for each of the two roll stands 6 and 7. Alternatively to each one of the torque sensors 11 and 15, the system has one load-torque observer 21 and 14 associated with each roll stand 6 and 7. Each of the two load-torque observers 14 and 21 determines a value for the load torque 33 or 34 from values for the motor current 17 or 26 and the roll rotational speed 18 or 27. A tensile-force regulator 13 supplies the manipulated variables for the regulators 31 and 32, nominal speed 22 and nominal torque 23. The tensile-force regulator 13 determines the nominal speed 22 and the nominal torque 23 from the roll force 12 of the first stand 6, as well as from the values for the load torque 16 and 25 or 33 and 34, which are generated by the load-torque observers 14 and 21 or alternatively, measured by the torque sensors 11 and 15.

Figure 4:
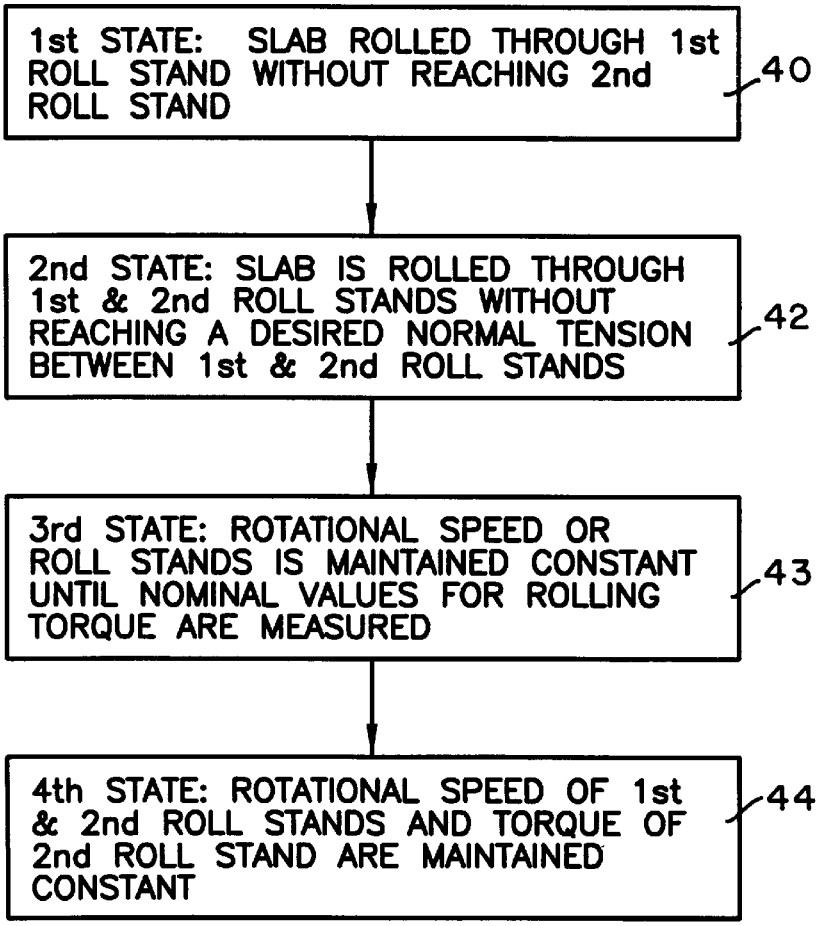
FIG. 4 is a block diagram of a state transition diagram.

FIG. 4 illustrates a state transition diagram for a train of rolls, which is controlled with the method according to the present invention. The train of rolls is initially in the state 40, i.e., the state in which the slab is first rolled with the first roll stand, but has not yet reached the second roll stand. In this state, the values of the strip tension in a tension-free state are determined in the first roll stand for the roll force and the roll torque. When the slab reaches the second roll stand, the system turns to state 42. In state 42, the slab is rolled by both roll stands, however, the nominal tension in the slab desired between the first and the second roll stand is not yet reached. In state 42, the rotational speed in the second roll stand is kept constant, and the torque in the first roll stand is regulated so as to build up the tension desired in the slab between the first and the second roll stand. If the desired tension is reached in the slab between the first and the second roll stand, then the system turns to state 43. The actual and nominal tension are advantageously not directly compared, but rather through a comparison between the actual roll torque and a reference torque. One can thus eliminate a tensile measurement. In state 43, the rotational speeds of roll stands 6 and 7 are maintained constant until the nominal values for rolling torque of the roll stand 7 at steady-state tension are measured using the torque sensor 15 or the load torque observer 21. In state 44, the rotational speed of the first roll stand and the torque of the second roll stand are kept constant.

Figure 5:
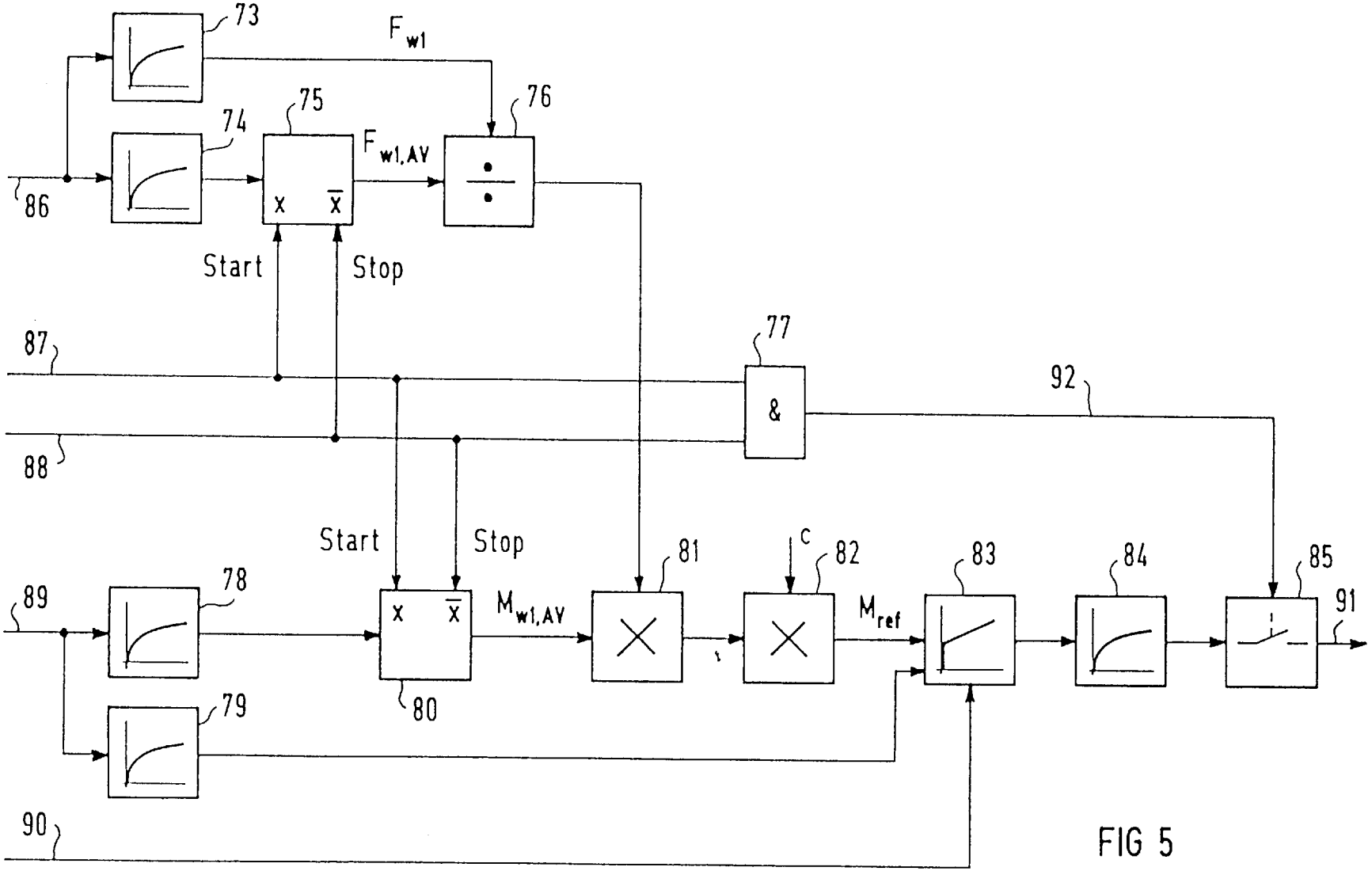
FIG. 5 is a block diagram illustrating torque control for the first roll stand.

FIG. 5 depicts a closed-loop control of rolling torque for the first roll stand. Input variables of the closed-loop control are the roll force 86 of the first roll stand, a signal 87, which indicates the slab being passed into the first roll stand, a signal 88, which indicates the slab being passed into the second roll stand, the roll torque 89 in the first roll stand, as well as a hold signal 90. The output variable of the closed-loop control is a manipulated variable 91 for the motor speed. The measured value of the roll force 86 is initially smoothed through two low-pass filters 73 and 74. Both low-pass filters 73 and 74 smooth the measured value of the roll force 86, however, they can be realized with different time constants. The low-pass filter 73 generates an output signal $F_{w1}$. From the output signal of the low-pass filter 74, an average value signal $F_{w1,Av}$ is generated in a signal averager 75. The averaging takes place during the time in which the slab is passed into the first roll stand, but not yet into the second roll stand. For this purpose, the averager 75 is fed the signal 87, which signals the guiding of the slab into the first roll stand, and the signal 88, which signals the guiding of the slab into the second roll stand. In a downstream divider 76, the output signal $F_{w1}$ from the low-pass filter 73 is divided by the output signal $F_{w1,Av}$ from the averager 75.

The measured value of the roll torque 89 of the first roll stand is likewise low-pass filtered. To this end, the control has two other low-pass filters 78 and 79, which smooth the measured value of the roll torque 89. The output signal from the low-pass filter 78 is fed to an averager 80, which generates an average value of the roll torque analogously to the averaging of the roll force by means of the averager 80. The output signal $M_{w1,Av}$ from the averager 80 is multiplied by the output signal from the divider 76 in a multiplication block 81. By multiplying the output signal from the multiplier 81 by a constant C in the multiplier 82, a reference torque $M_{ref}$ is attained, which is used as a variable that is equivalent to the strip tension for controlling strip tension. The factor C is determined by the equation:

$$C = 1 - \frac{R_1 T_{ref}}{M_{w1,AV}}$$

where $R_1$ is the roll diameter of the first roll stand and $T_{ref}$ is the desired nominal tension in the slab between the first and the second roll stand. The reference torque $M_{ref}$ is fed as a setpoint variable to a PI controller 83. As an actual value, the PI-controller 83 receives the measured value of the roll torque 89, which is smoothed by the low-pass filter 79. The output signal from the PI controller 83 is smoothed in a low-pass filter 84. The output signal from the low-pass filter 84 is supplied to a switch 85. The switch 85 switches through the output signal from the low-pass filter 84 as a manipulated variable 91 for controlling the first roll stand speed after the slab has been passed into the second roll stand. For this purpose, a signal 92, which is applied to the output of an AND gate 77 for gating the signals 87 and 88, is fed to the switch 85. To limit the PI-controller 83, given an open control loop, a hold signal 90, which holds the integrator of the PI-controller 83 to a value that corresponds to the maximum motor torque, is fed to the PI-controller 83.

Figure 6:
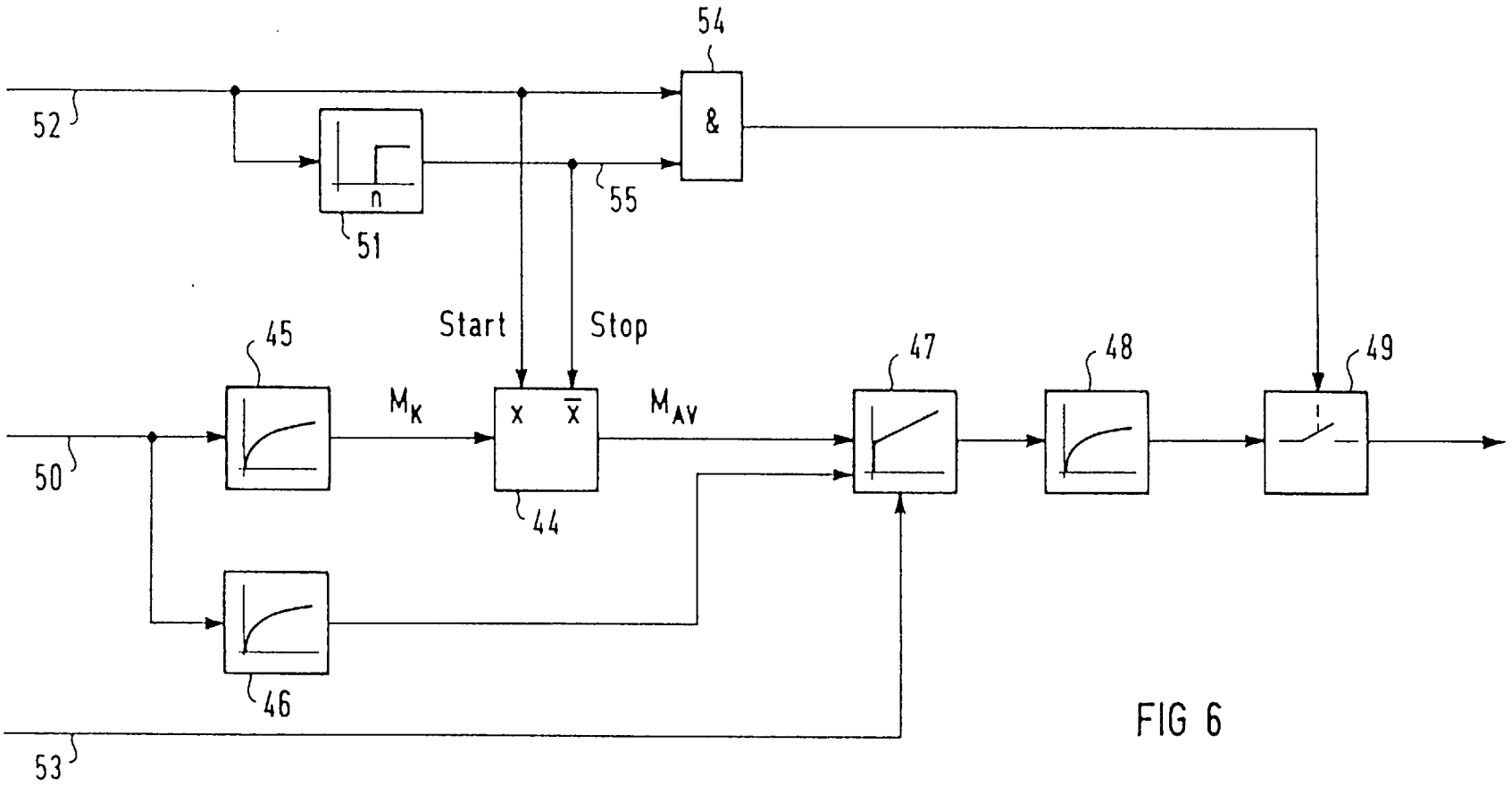
FIG. 6 is a block diagram illustrating torque control for the second roll stand.

FIG. 6 illustrates a closed-loop control structure for controlling torque in the second roll stand. For controlling torque in the second roll stand, the measured value of the torque 50 in the second roll stand is initially smoothed in two low-pass filters 45 and 46. A setpoint value $M_{AV}$ for the torque in the second roll stand is generated from the signal of the roll torque of the second roll stand smoothed by the low-pass filter 45. The average value is generated by applying a signal 52 which signals that the nominal tension in the slab has been reached. The signal 52 is fed to a lag element 51, which delays the signal 52 over N sampling steps. After the N sampling steps have elapsed, the average value generation in the averager 44 is halted. The setpoint value $M_{AV}$, i.e., the time average of the smoothed measured values $M_K$, forms the setpoint variable for a downstream PI controller 47. Therefore, the setpoint value $M_{AV}$ is generated in accordance with the equation:

$$M_{AV} = \frac{1}{n} \sum_{K=1}^{n} M_K.$$

The difference between the setpoint value $M_{AV}$ and the measured value of the torque in the second roll stand 50 smoothed by the low-pass filter 46 makes up the system deviation for the PI controller 47.

If the desired motor torque determined by the PI-controller 47 exceeds the maximum possible motor torque of the drive of the second roll stand, then the integrator of the PI-controller 47 is held constant by the signal 53 to a value that corresponds to the maximum motor torque. The output signal from the PI-controller 47 is filtered through a low-pass filter 48. The output of the controller is released by the switch 49. By gating the signal 52 with the signal 55 delayed by the lag element 51, it is ensured that the controller depicted in FIG. 6 does not control the speed of the second roll stand until after the average value generation has been completed in the averager 44.

Figure 7:
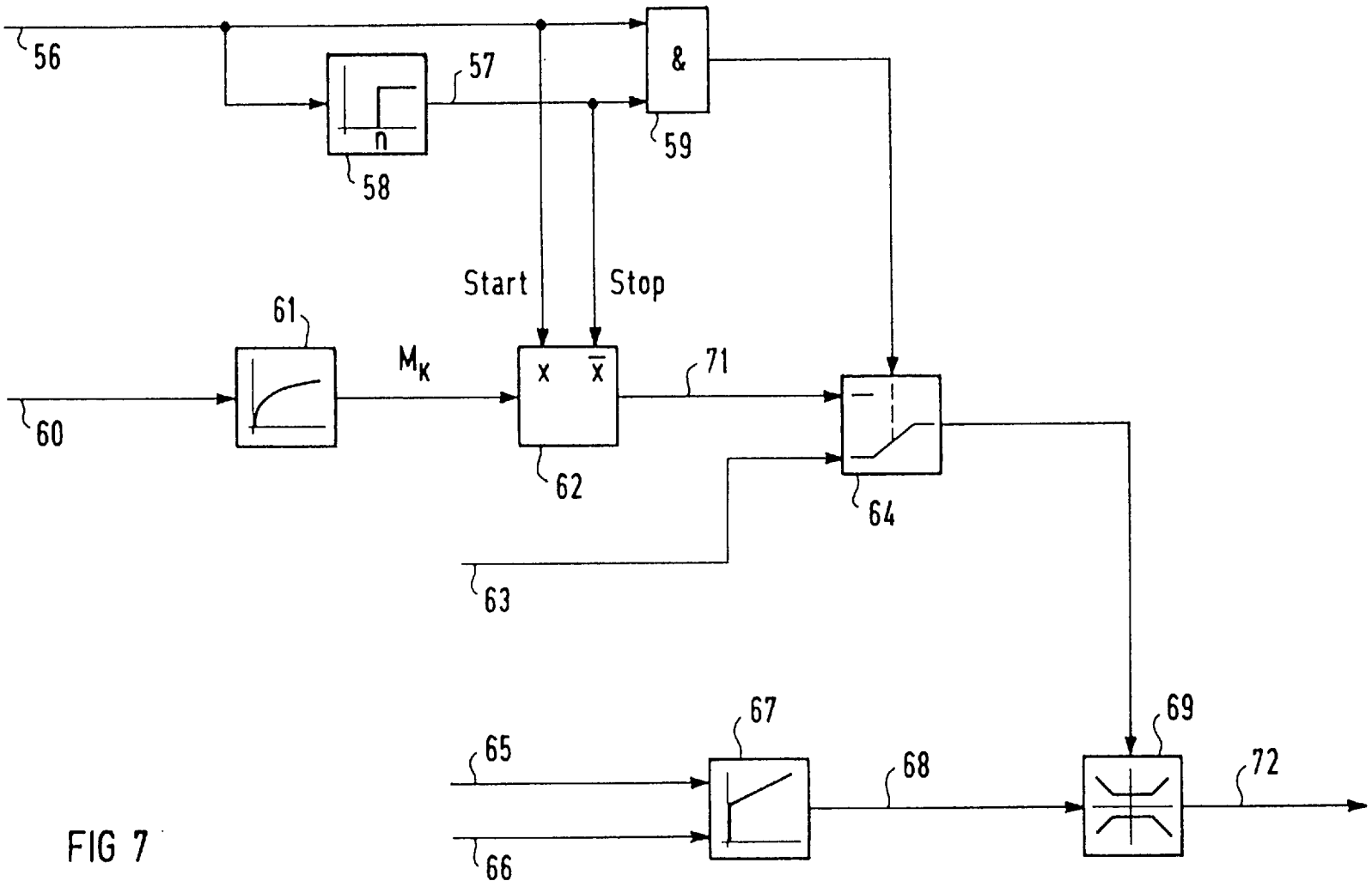
FIG. 7 is a block diagram illustrating alternate torque control for the second roll stand.

FIG. 7 shows an alternative to the torque control of FIG. 6. The values 56, 57 or 60 correspond to the values 52, 55 or 50 of FIG. 6, and the functional blocks 58, 59, 61 or 62 correspond to the functional blocks 51, 54, 45 or 44 of FIG. 6. In contrast to the averager 44 of FIG. 6, the averager 62 of FIG. 7 does not calculate a single value for the nominal torque $M_{AV}$, but rather an upper and a lower limit for limiting the motor current for the second roll stand. These limits amount advantageously to ±1% of the nominal torque $M_{AV}$. Until the average value generation in the averager 62 is concluded, one works with standard limits 63. After conclusion of the averaging, the switch-over is made by means of the switch 64 from standard limits 63 to the limits 71 produced by the averager 62. The motor current 68 for driving the second roll stand is determined by a PI-speed controller 67, which is supplied with a setpoint value for the motor speed 65 and with a measured value of the rotational speed 66. However, the PI-controller 67 stipulates the setpoint value for the motor current 68 in the form of a manipulated variable 72 only when the manipulated variable 72 is not restricted by the limiter 69. For that reason, the block diagram of FIG. 7 functions in the manner of a transfer circuit, the rotational-speed closed-loop control being overridden by a torque open-loop control, represented by the functional blocks 58, 59, 61, 62 and 64.

We claim:

1. A method for rolling a slab having a variable thickness along its length using first and second roll stands, comprising the steps of:

advancing the slab through the first and second roll stands while maintaining a substantially constant and low tension in the slab between the first and second roll stands; and maintaining a substantially constant thickness of the slab at an output of the first and second roll stands.

2. The method of claim 1, further comprising the step of:

maintaining a substantially constant rotational speed of the first roll stand and a substantially constant torque of the second roll stand.

3. The method of claim 1, further comprising the steps of:

maintaining a substantially constant speed of the second roll stand; and controlling a torque of the first roll stand until the substantially constant and low tension in the slab between the first and second roll stands is attained.

4. The method of claim 3, further comprising the step of:

determining a reference torque value using a computing arrangement as a function of the desired tension and the roll force in the first roll stand.

5. The method of claim 4, wherein the computing arrangement determines the reference torque value according to the equation:

$$M_{ref} = C\, M_{w1,AV} \cdot \frac{(F_{w1})}{F_{w1,AV}}$$

wherein:

$F_{w1}$ is the active roll force in the first roll stand;

$F_{w1,AV}$ is the roll force in the first roll stand before the slab reaches the second roll stand;

$M_{w1,AV}$ is the torque in the first roll stand before the slab reaches the second roll stand; and C is a factor for adjusting the desired nominal tension.

6. The method of claim 5, wherein the factor is determined by the equation:

$$C = 1 - \frac{R_1 T_{ref}}{M_{w1,AV}}$$

wherein:

C is the factor;

$R_1$ is the roll diameter of the first roll stand; and $T_{ref}$ is the desired nominal tension in the slab between the first and the second roll stand.

7. A system for rolling a slab having a variable thickness along its length, comprising:

at least two roll stands; and means for advancing a slab through the first and second roll stands while maintaining substantially constant slab thickness at outputs of the at least two roll strands.

8. The system of claim 7, further comprising:

an evaluation unit for evaluating the variable thickness.

9. The system of claim 8, wherein the evaluation unit includes at one of a single-chip computer, in particular as a micro-controller, a multi-chip computer and a programmable controller.

10. The system of claim 8, wherein the evaluation unit includes at least one of a programmable controller, a SIMADYN-D system, a VME bus system and an industrial PC.

* * * * *